US009275816B2

(12) United States Patent
Koprivsek

(10) Patent No.: US 9,275,816 B2
(45) Date of Patent: Mar. 1, 2016

(54) SWITCH FOR PROTECTION OF ELECTRIC CIRCUIT AGAINST OVERLOADING

(71) Applicant: RAZVOJNI CENTER ENEM NOVI MATERIALI D.O.O., Zagorje ob Savi (SI)

(72) Inventor: Mitja Koprivsek, Izlake (SI)

(73) Assignee: RAVOJNI CENTER ENEM NOVI MATERIALI D.O.O., Zagorje Ob Savi (SI)

( * ) Notice: Subject to any disclaimer, the term of this patent is extended or adjusted under 35 U.S.C. 154(b) by 0 days.

(21) Appl. No.: 14/394,256

(22) PCT Filed: Dec. 5, 2012

(86) PCT No.: PCT/SI2012/000064
§ 371 (c)(1),
(2) Date: Oct. 13, 2014

(87) PCT Pub. No.: WO2013/154505
PCT Pub. Date: Oct. 17, 2013

(65) Prior Publication Data

US 2015/0102875 A1 Apr. 16, 2015

(30) Foreign Application Priority Data

Apr. 12, 2012 (SI) ..... 201200112

(51) Int. Cl.
*H01H 77/06* (2006.01)
*H01H 89/00* (2006.01)
(Continued)

(52) U.S. Cl.
CPC ..... *H01H 89/00* (2013.01); *H01H 37/52* (2013.01); *H01H 37/64* (2013.01); *H01H 50/54* (2013.01); *H01H 50/641* (2013.01); *H01H 71/40* (2013.01)

(58) Field of Classification Search
CPC ..... H01H 33/02; H01H 67/02; H01H 9/00; H01H 9/20; H01H 9/30; H01H 73/00
USPC ..... 335/38
See application file for complete search history.

(56) References Cited

U.S. PATENT DOCUMENTS 1,838,664 A * 12/1931 Dubilier ..... H01H 71/18 218/143
1,947,276 A * 2/1934 Sachs ..... H01H 73/18 200/405

(Continued)

FOREIGN PATENT DOCUMENTS

EP 0023277 2/1981
WO WO03/079388 9/2003

OTHER PUBLICATIONS

International Search Report filed in PCT App. Serial No. PCT/SI2012/000064 with mailing date of Jun. 14, 2013 (4 pages).

*Primary Examiner* — Shawki S Ismail
*Assistant Examiner* — Lisa Homza
(74) *Attorney, Agent, or Firm* — Haynes and Boone, LLP; William B. Nash; Jason W. Whitney

(57) ABSTRACT

The disclosure refers to a switch which is suitable to protect an electric circuit against overloading. The switch generally consists of a triggering assembly as well as of an interrupting assembly, wherein said triggering assembly comprises and induction unit, a thermic interrupter and an actuating needle. The induction unit comprises a coil with a yoke intended to displace the actuating needle towards the triggering assembly, when the short circuit occurs. Said thermic interrupter comprises a bimetallic membrane, which is mechanically interconnected with the actuating needle and is in the case of excess current and generating of heat displaced towards the interrupting assembly. In order to provide such switch, which could moreover enable protection against transient voltage, e.g. due to thunder bolt, such switch is furnished with a varistor, which is located within the triggering assembly in a heat-conductive relationship with said thermic interrupter.

9 Claims, 3 Drawing Sheets

(51) Int. Cl.

| | |
|---|---|
| ***H01H 71/40*** | (2006.01) |
| ***H01H 37/52*** | (2006.01) |
| ***H01H 37/64*** | (2006.01) |
| ***H01H 50/54*** | (2006.01) |
| ***H01H 50/64*** | (2006.01) |

(56) References Cited

U.S. PATENT DOCUMENTS 2,140,360 A * 12/1938 Jennings ..... H01H 71/121 200/401
2,458,804 A * 1/1949 Sundt ..... H01H 73/24 218/147
2,701,831 A * 2/1955 Hirons ..... H01H 33/14 218/5
RE23,971 E * 3/1955 Ingwersen ..... H01H 73/18 218/31
2,733,312 A * 1/1956 Christensen ..... H01H 73/18 218/36
3,129,307 A * 4/1964 De Vargas ..... H01H 3/3052 218/1
3,956,723 A * 5/1976 Dickens ..... H01H 9/42 218/26
4,001,743 A * 1/1977 Arnhold ..... H01H 73/18 218/151
4,021,759 A 5/1977 Campi
4,168,514 A 9/1979 Howell
5,162,765 A * 11/1992 DiVincenzo ..... H01H 71/2409 335/172
5,185,590 A * 2/1993 DiVincenzo ..... H01H 9/46 218/40
5,214,402 A * 5/1993 DiVincenzo ..... H01H 71/1027 335/167
5,453,723 A * 9/1995 Fello ..... H01H 9/342 335/18
5,510,759 A * 4/1996 Gula ..... H01H 83/226 335/18
6,111,212 A * 8/2000 DuPont ..... H01H 33/75 218/154
6,255,923 B1 * 7/2001 Mason, Jr. ..... H01H 71/123 338/18
6,259,340 B1 * 7/2001 Fuhr ..... H01H 71/128 335/18
6,310,528 B1 * 10/2001 Kuboyama ..... H01H 71/2409 335/132
6,313,723 B1 11/2001 Chen
6,479,780 B2 * 11/2002 Virtanen ..... H01H 71/122 200/400

* cited by examiner

SWITCH FOR PROTECTION OF ELECTRIC CIRCUIT AGAINST OVERLOADING

CROSS-REFERENCE TO RELATED APPLICATION

This application is a United States national phase application of co-pending international patent application number PCT/SI2012/000064, filed Dec. 5, 2012, which claims the benefit of Slovenia Application No. P-201200112 filed Apr. 12, 2012, of which is hereby incorporated by reference in its entirety.

BACKGROUND

The present disclosure refers to electricity, namely to basic electric elements, in particular to electric switches as well as to details of protective switches, which are triggered by means of combination of electrothermal and electromagnetic mechanism and are actuated by means of appropriate lever.

Embodiments of the present disclosure are directed to a switch, which could be integrated into each disposable electric circuit in order to protect it against short-circuit current and also against long-term excess current and/or voltage overloading, and moreover also against transient voltage, wherein such switch should have smallest possible dimensions and should be similarly like the other analogous switches integrated into a standardized casing adapted for mounting on a standardized ledge within common electric switchboards.

A switch for protecting against a current overloading or overloading due to excess current is described in DE 36 37 275 A1. Such switch comprises a core, which is inserted within a tubular casing and is furnished with a central passage, through which an axially movable actuating needle is inserted and protrudes therefrom towards the interrupting member i.e. a member, which is capable either to maintain the circuit established or to interrupt promptly and reliably the circuit, as soon as the actuating needle abuts it with the actuating end portion thereof. Said casing is wrapped with an electric conductive wire, which forms an electric winding i.e. a coil. In addition to said coil, an electromagnetic yoke is foreseen on the external surface of said casing, by which the coil is surrounded. The actuating needle is furnished with a widening, which is arranged apart from said core, so that the core is located on the one side of said widening, and the electromagnetic anchor is located on the opposite side thereof. A compression spring is inserted between said anchor and said core, so that the needle is surrounded with said spring. The needle extends throughout the core and also throughout the anchor, which is however axially feed on the needle. The actuating needle extends throughout said anchor and protrudes towards a bimetallic membrane, which is at room temperature deflected in a direction apart from the anchor and the core and is located apart from the corresponding end portion of the actuating needle, whilst by increasing of temperature it is deflected in the opposite direction i.e. towards the anchor and the core, and is rest onto that end portion of the actuating needle, which is protruding against it.

When the switch is integrated into each disposable electric circuit, the first end portion of the actuating needle is located apart from the bimetallic membrane, and the second end portion is located apart from the interrupting member, by which the electric circuit is established. Whenever the short-circuit current arises, the voltage is increased and appropriate magnetic field is generated within the coil, by which the anchor is shifted towards the core and the interrupting member by simultaneously abutting said widening on the needle, which is then pressed towards the interrupting member, by which, the circuit is interrupted.

Whenever a long-term excess current or voltage overloading arises, the heat is generated within the electric conductors, and the heat is transferred towards the bimetallic membrane, which is deflected in a direction towards the actuating needle in order to displace the last towards the interrupting member, by which the circuit is then interrupted. Meanwhile, the spring between the core and the anchor is compressed. As soon as the excess current is eliminated, the temperature in the area of the bimetallic membrane is decreasing, and the membrane is deflected back to its initial position, by which, the interrupting member allows establishing of the electric circuit and former operating thereof.

When considering the response of the anchor and/or the bimetallic membrane with respect to each irregularities within the electric circuit, such protective switch is able to react to irregularities or overloading in the context of excess current or voltage over loading within several ms. However, the so-called transient voltage, which occur e.g. in lightning, duration of each overvoltage stroke is usually several μs, so that effects and consequences thereof cannot be prevented by means of the previously mentioned switch, since neither the coil nor the bimetallic membrane is able to respond in such short time period.

Still further, a modular protecting apparatus is described in SI 21584A, which consists of a switch, which is triggered by means of the magnetic field, as well as of an overvoltage protecting circuit, which is serial connected to said switch in order to establish a common circuit. The switch is pretty similar to those described in DE 36 37 275 A1 and comprises a casing with a core and an anchor, as well as an actuating needle, which extends there-through and can be rest onto an interrupting member of the switch, by which the circuit is interrupted in the case of overloading. As soon as an excessive current or a voltage overloading takes place, a corresponding magnetic field is generated within the coil, which leads to displacing the anchor as well as the actuating needle towards the interrupting member. Said overvoltage protecting circuit comprises varistors, which are in parallel connected to each other and are intended to protect other components of the electric circuit from being overloaded in particular when transient voltage could arise. Such apparatus is then capable to protect the circuit against a short-circuit current and partially also against transient voltage, but the problem may arise, if the circuit needs to be protected against a voltage overloading, which would have some longer durability. In a practical circuit with nominal voltage 220 or 230 V this would mean a voltage overloading up to approx. 300 to 400 V in duration of approx. 1 s. In such case it could happen, that the magnetic field generated by the coil might be insufficient for triggering the actuating needle and interrupting the circuit, since due to such long-term voltage overloading also the varistors are thermally overloaded, which leads to destroying, even to explosion of varistors.

SUMMARY

The present disclosure refers to a switch for protecting of an electric circuit against overloading, wherein such switch generally comprises a triggering assembly and an interrupting assembly, which are adjusted to cooperate with each other. Said interrupting assembly is adapted to interrupt each electric circuit, which is established by means of at least one phase conductor and at least one neutral conductor together with said switch and at least one electric user or load, when appropriate, and on the basis of receiving an impulse from the side of said triggering assembly. Said triggering assembly comprises an induction unit a thermic interrupter and an actuating needle, which is suitable for generating an impulse, on the basis of which the interrupting assembly is able to interrupt said electric circuit. The induction unit comprises at least a casing, which at the same time represents an electromagnetic yoke, as well as a coil, which is electrically integrated within said electric circuit for the purposes generating a magnetic field due to induced voltage, when the short-circuit current arises within said electric circuit; and moreover an anchor, which is mechanically interconnected with said actuating needle, which is axially displaceable towards the interrupting assembly by means of the magnetic field generated by said coil. Said thermic interrupter is arranged adjacent to said induction unit and in a thermic-conductive contact therewith, and comprises a bimetallic membrane, which is mechanically interconnected with the previously mentioned actuating needle and is moreover, when heated due to current overloading within said electric circuit, in a direction of said actuating needle axially displaceable from its initial position towards the interrupting assembly due to generating an impulse, on the basis of which the circuit is then promptly interrupted, and when cooled again, it is automatically returned back to its initial position.

According to an embodiment of the present disclosure, at least one varistor is foreseen within such switch in the area of said triggering assembly, and is separately connected within said electric circuit and arranged in a heat-conductive contact with said thermic interrupter.

In a preferred embodiment said varistor is available in the form of a hollow cylinder.

The coil can be surrounded with such varistor and arranged in a heat-conductive contact with the thermic interrupter, wherein such heat conductive contact is then also established between the coil and the varistor.

In one embodiment, the first electric contact of the varistor is electrically connected to the phase conductor of the electric circuit, while the second electric contact of the varistor is electrically connected to the neutral conductor of the electric circuit.

In an alternative embodiment, the first electric contact of the varistor is electrically connected to the phase conductor of the electric circuit, while the second electric contact of the varistor is electrically connected to the earth conductor of the electric circuit.

The present disclosure will be further explained by means of embodiments, which are presented in the attached drawings and written description.

DETAILED DESCRIPTION

As presented in FIGS. 1-4, a switch S according to this disclosure can be integrated into an electric circuit, which is formed by said switch, by phase conductor $L_1$, $L_2$, by neutral conductor $N_1$, $N_2$, as well as by at least one load, which is not separately shown. When said circuit is established, during the regular use a nominal current is available within said conductors $L_1$, $L_2$; $N_1$, $N_2$. The switch S generally consists of a triggering assembly A and an interrupting assembly B.

The triggering assembly A is intended to detect each anticipated irregularities within said circuit in order to react to said irregularities by means of engaging the interrupting assembly B, by means of which in such cases the circuit is interrupted in order to eliminate the current I within the conductors $L_1$, $L_2$; $N_1$, $N_2$.

Figure 1:
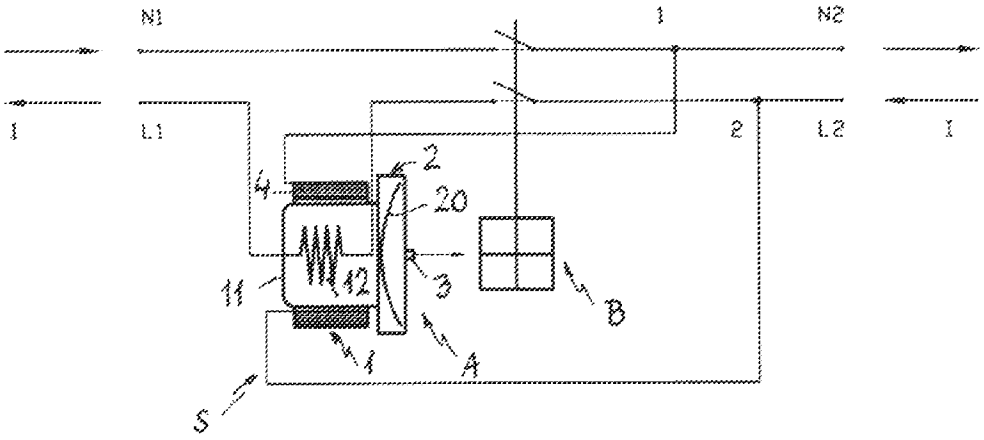
FIG. 1 is a schematically presented concept of the switch for protection of an electric circuit against electric overloading according to the present disclosure, namely in a state, when the circuit is interrupted, upon the short-circuit current arose.
Figure 2:
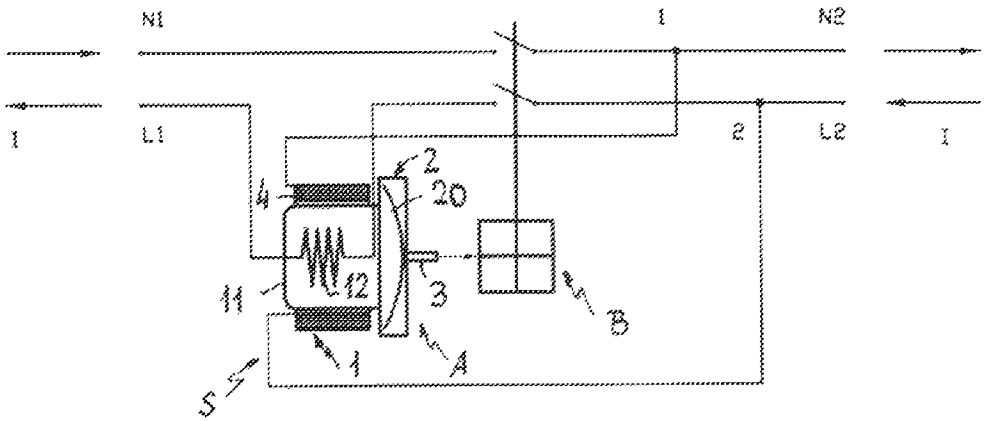
FIG. 2 is a schematically presented concept of the switch like in FIG. 1, however in a state, when the circuit is interrupted due to excessive current.

As schematically presented in FIGS. 1 and 2, the triggering assembly comprises

- an induction unit 1, which is electrically connected within said circuit;
- a thermic interrupter 2, which is arranged adjacent to the inductive unit 1 and in heat-conductive relationship therewith, by which a heat transfer from the induction unit 1 to the thermic interrupter 2 is enabled;
- an actuating needle 3, to which both the inductive unit 1 and the thermal interrupter 2 are mechanically connected, and which is intended to trigger the interrupting assembly B;
- a varistor 4, in particular a hollow cylindrical varistor 4 in the form of a longitudinal tubular section with a round cross-section, which is also arranged in a heat-conductive relationship with the thermal interrupter 2, wherein said varistor 4 is individually connected within said circuit, which in accordance with the embodiment means that the connectors of said varistor 4 are each per se connected with connectors $L_1$, $L_2$; $N_1$, $N_2$ of the circuit, or the first connector of the varistor 4 is connected to the phase conductor $L_1$, $L_2$, and the second connector is connected to the earth conductor, which should be easily understood by person skilled in the art and is therefore not separately shown in the drawing.

Figure 3:
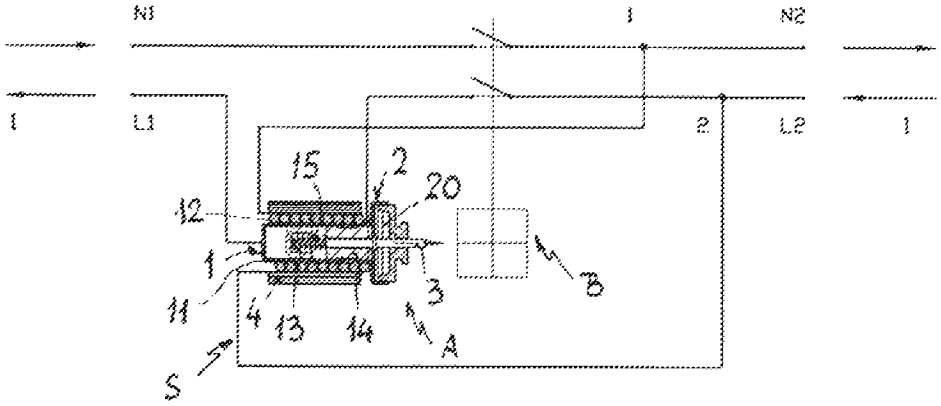
FIG. 3 presents a triggering assembly of the switch according the present disclosure at the moment when the circuit is interrupted due to the presence of the short-circuit current.
Figure 4:
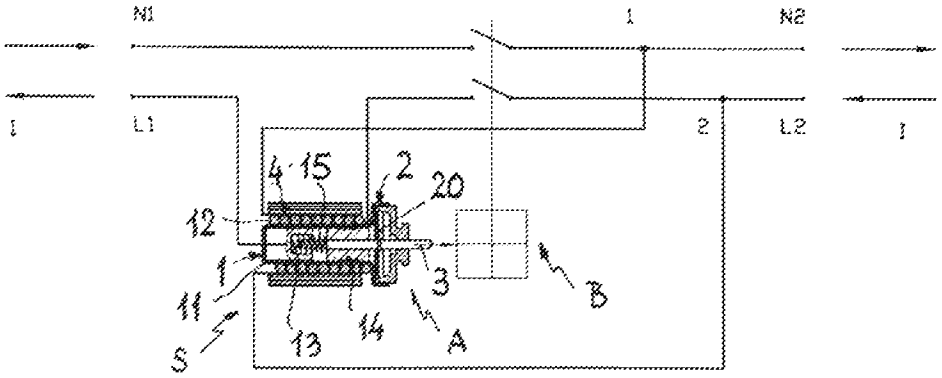
FIG. 4 presents a triggering assembly of the switch according the present disclosure, wherein the circuit is interrupted dye to the presence of the excessive current.

A concept of the triggering assembly A is shown in detail in FIGS. 3 and 4. The induction unit 1 consists of a casing 11, which is also functioning as electromagnetic yoke, around which an electric coil 12 is wound, which is electrically connected into each disposable electric circuit, in this particular case by means of an electric conductor $L_1$, $L_2$, which extends therethrough. In the shown embodiment, a core 13 and an anchor 14 are arranged within said casing 11, a spring 15 is arranged there-between, and an actuating needle 3 extends there-through, protruding at the same time outside from the casing 1 towards the interrupting assembly B. Thanks to the anchor 14, said actuating needle 3 is displaced towards the interrupting assembly B by means of a magnetic field, which is generated within said coil 12 due to increased voltage, whenever the short-circuit current occurs, as shown in FIGS. 2 and 3. As soon as the electric current is normalized, the magnetic field is eliminated, upon which the anchor 12 is returned back together with the actuating needle 3 to its initial position, and the interrupting assembly B is then able to establish the electric circuit again.

In the shown embodiment (FIGS. 3 and 4), the casing 11 of the induction unit 1 is expanded on the side of the interrupting assembly B, namely in the area, where the actuating needle 3 protrudes outside from the casing 11, and the casing 11 is moreover adapted to receive a thermic interrupter 2, which is furnished with a bimetallic membrane 20, which is mechanically interconnected with the actuating needle 3 in order to operate as shown in FIGS. 1 and 2. At room temperature, said bimetallic membrane 20 is deflected in a direction away from the interrupting assembly B. When excessive current arises, heat is generated within the coil 12 and is then transferred, generally conducted, towards the thermic interrupter 2, and the bimetallic membrane 20 reacts by shifting into another position, in which it is deflected towards the interrupting assembly 2. Consequently, the actuating needle 3 is shifted towards the interrupting assembly 2, by which the circuit is promptly interrupted.

In accordance with the embodiment, a varistor 4 is integrated in the area of the triggering assembly A of the switch S adjacent to the inducting unit 1, and is available as a hollow cylinder i.e., a straight section of a tube having a round cross-section, and is moreover solely integrated into each disposable electric circuit for the purposes of dealing with transient voltages in duration of several μs. Said varistor 4 is either indirectly or via the induction unit 1 set into a heat conductive contact with the thermic interrupter 2.

Whenever a short-circuit current arises, the coil 12 reacts on such irregularity by generating a magnetic field, due to which the anchor 14 is shifted towards the interrupting assembly B, by which the actuating needle 3 is displaced by means of said anchor 14 and appropriate impulse is generated, by which the electric circuit is promptly interrupted. Whenever a durable voltage or current overloading takes place, heat is generated within the varistor 4, which generally jeopardizes functioning of said varistor 4 and could during the time damage the varistor 4 as such. However, thanks to previously described approach in this disclosure, each generated heat is fluently conducted towards the thermic interrupter 2, so that by means of said bimetallic membrane 20 and displacing the actuating needle 3, the electric circuit is promptly interrupted, and the varistor 4 is thus prevented from overheating. Thanks to such synergic effects, which result from the previously described concept of integration of the varistor 4 into said switch S, each disposable loads within the electric circuit, including the coil 12 of the switch S itself, are then efficiently protected against transient voltage, e.g. during lightning, while simultaneously also the varistor 4 is protected against overheating, which would otherwise occur die to long-term voltage or current overloading thereof.

Figure 5:
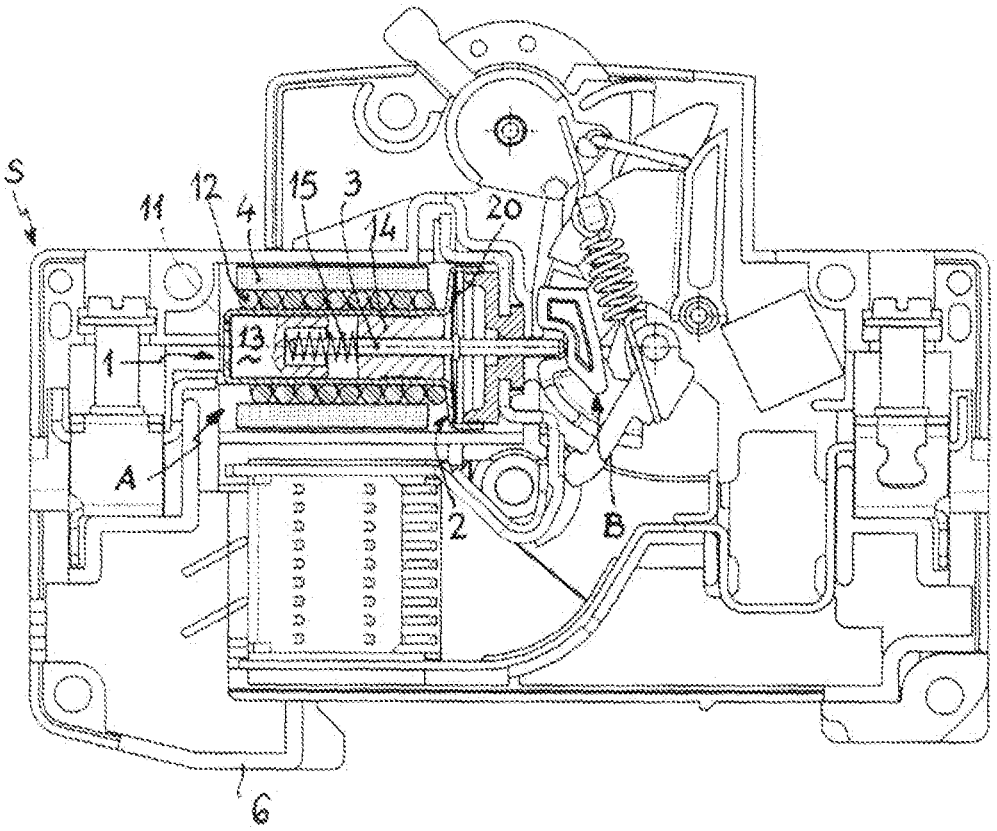
FIG. 5 is a quite practical embodiment of a switch, suitable to protect an electric circuit against overloading, where the interrupting assembly according to FIGS. 3 and 4 is mounted within a casing pursuant to the international standard IEC 60898, the width of which is 81 mm or a multiplied value thereof.

A quite practical embodiment of the switch S according to this disclosure is illustrated in FIG. 5, and is arranged within a casing 6 corresponding to the international standard IEC 60898 and adjusted for attachment onto a not-shown ledge in each disposable electric panel, which is also not separately shown. All essential features of the triggering assembly A and the interrupting assembly B were already described in relationship with FIGS. 1 to 4, while the other parts of the switch S are practically irrelevant for the purposes of understanding of this embodiment, and are already known e.g. from PCT/SI2010/000074 and described in more detail therein. Those skilled in the art should understand, that the usual protective switch S, which comprises the induction unit 1 and the thermic interrupter 2 with the actuating needle 3, which is in the case of overloading due to a short-circuit current or excessive current capable to trigger the interrupting assembly B in order to promptly interrupt the circuit, is in accordance with the present disclosure and the previously mentioned synergic effect simply upgraded with a hollow cylindrical varistor 4, by which the switch S is then capable to protect the circuit against transient voltage damages, and by which the switch S and the casing 6 thereof remain completely unchanged, and by which moreover also the reliability of the switch S as such remains completely unchanged.

The invention claimed is:

1. Switch (S) for protecting of electric circuit ($L_1$, $L_2$; $N_1$, $N_2$) against overloading, comprising a triggering assembly (A) as well as an interrupting assembly (B), which are adjusted to cooperate with each other, wherein said interrupting assembly (B) is adapted to interrupt each electric circuit ($L_1$, $L_2$; $N_1$, $N_2$), which is established by means of at least one phase conductor ($L_1$, $L_2$) and at least one neutral conductor ($N_1$, $N_2$) together with said switch (S) and at least one electric user i.e. each load, on the basis of receiving an impulse from the side of said triggering assembly (A);

and wherein said triggering assembly (A) comprises an induction unit (1), a thermic interrupter (2) and an actuating needle (3) suitable for generating an impulse, on the basis of which the interrupting assembly (B) is then able to interrupt said electric circuit;

wherein the induction unit (1) comprises at least a casing (11), which is functioning as an electromagnetic yoke, a coil (12), which is electrically integrated within said electric circuit for the purposes generating a magnetic field due to induced voltage, when the short circuit current occurs within said electric circuit; as well as an anchor (14), which is mechanically interconnected with said actuating needle (3), which is axially displaceable towards the interrupting assembly (B) by means of the magnetic field whenever generated by said coil (12);

and wherein said thermic interrupter (2) is arranged adjacent to the induction unit (1) and in a thermal-conductive contact therewith, and comprises a bimetallic membrane (20), which is mechanically interconnected with the previously mentioned actuating needle (3) and is moreover, when heated due to current overloading within said electric circuit, in a direction of said actuating needle (3) axially displaceable from its initial position towards the interrupting assembly (B) due to generating an impulse, on the basis of which the circuit is then promptly interrupted, and when cooled again, it is automatically returned back to its initial position, characterized in that at least one varistor (4) is foreseen in the area of said triggering assembly (A), and is separately connected within said electric circuit ($L_1$, $L_2$; $N_1$, $N_2$) and arranged in a heat-conductive contact with said thermic interrupter (2).

2. Switch according to claim 1, characterized in that the varistor (4) is shaped as a hollow cylinder.

3. Switch according to of claim 2, characterized in that the first electric contact of the varistor (4) is electrically connected to the phase conductor ($L_1$, $L_2$) of the electric circuit ($L_1$, $L_2$; $N_1$, $N_2$), while the second electric contact of the varistor (4) is electrically connected to the earth conductor of the electric circuit ($L_1$, $L_2$; $N_1$, $N_2$).

4. Switch according to claim 2, characterized in that the first electric contact of the varistor (4) is electrically connected to the phase conductor ($L_1$, $L_2$) of the electric circuit ($L_1$, $L_2$; $N_1$, $N_2$), while the second electric contact of the varistor (4) is electrically connected to the neutral conductor ($N_1$, $N_2$) of the electric circuit ($L_1$, $L_2$; $N_1$, $N_2$).

5. Switch according to claim 1, characterized in that the coil (12) is surrounded with the varistor (4) and is arranged in a heat-conductive contact with the thermic interrupter (2), wherein such heat conductive contact is also established between the coil (12) and the varistor (4).

6. Switch according to claim 5, characterized in that the first electric contact of the varistor (4) is electrically connected to the phase conductor ($L_1$, $L_2$) of the electric circuit ($L_1$, $L_2$; $N_1$, $N_2$), while the second electric contact of the varistor (4) is electrically connected to the neutral conductor ($N_1$, $N_2$) of the electric circuit ($L_1$, $L_2$; $N_1$, $N_2$).

7. Switch according to of claim 5, characterized in that the first electric contact of the varistor (4) is electrically connected to the phase conductor ($L_1$, $L_2$) of the electric circuit ($L_1$, $L_2$; $N_1$, $N_2$) while the second electric contact of the varistor (4) is electrically connected to the earth conductor of the electric circuit ($L_1$, $L_2$; $N_1$, $N_2$).

8. Switch according to claim 1, characterized in that the first electric contact of the varistor (4) is electrically connected to the phase conductor ($L_1$, $L_2$) of the electric circuit ($L_1$, $L_2$; $N_1$, $N_2$), while the second electric contact of the varistor (4) is electrically connected to the neutral conductor ($N_1$, $N_2$) of the electric circuit ($L_1$, $L_2$; $N_1$, $N_2$).

9. Switch according to of claim 1, characterized in that the first electric contact of the varistor (4) is electrically connected the phase conductor ($L_1$, $L_2$) of the electric circuit ($L_1$, $L_2$; $N_1$, $N_2$), while the second electric contact of the varistor (4) is electrically connected to the earth conductor of the electric circuit ($L_1$, $L_2$; $N_1$, $N_2$).

* * * * *